US006409055B1

(12) United States Patent
Officier

(10) Patent No.: US 6,409,055 B1
(45) Date of Patent: Jun. 25, 2002

(54) FILLING VALVE

(75) Inventor: Arthur Everardus Officier, Bunnik (NL)

(73) Assignee: Stork Bottling Systems B.V., Raamsdonksveer (NL)

( * ) Notice: Subject to any disclaimer, the term of this patent is extended or adjusted under 35 U.S.C. 154(b) by 0 days.

(21) Appl. No.: 09/434,868

(22) Filed: Nov. 4, 1999

(30) Foreign Application Priority Data

Nov. 16, 1998 (NL) ..... 1010562

(51) Int. Cl.[7] ..... B65D 47/00

(52) U.S. Cl. ..... 222/559; 222/571; 251/122

(58) Field of Search ..... 222/571, 539, 222/504; 251/122; 239/500, 583, 584

(56) References Cited

U.S. PATENT DOCUMENTS

| | | | | | |
|---|---|---|---|---|---|
| 1,846,446 | A | | 2/1932 | Maynard et al. | |
| 1,918,324 | A | * | 7/1933 | Dinner | 239/583 X |
| 1,919,232 | A | * | 7/1933 | Lee | 251/122 |
| 1,929,973 | A | * | 10/1933 | Haley | 251/122 X |
| 2,746,800 | A | * | 5/1956 | Voit | 239/584 |
| 3,035,780 | A | * | 5/1962 | Peras | 239/584 |
| 3,349,973 | A | * | 10/1967 | Smith | 222/571 |
| 3,589,560 | A | * | 6/1971 | Wilcox | 222/559 X |
| 3,791,590 | A | * | 2/1974 | Dieter | 222/571 X |
| 4,337,788 | A | * | 7/1982 | Seger | 251/122 X |
| 4,503,884 | A | * | 3/1985 | Spils | 251/122 X |
| 4,607,822 | A | * | 8/1986 | Schabert et al. | 251/122 X |
| 4,687,123 | A | * | 8/1987 | Hyde | 222/559 X |
| 4,726,522 | A | * | 2/1988 | Kokubo et al. | 239/500 X |
| 4,726,524 | A | * | 2/1988 | Ishikawa et al. | 239/500 X |
| 4,732,364 | A | * | 3/1988 | Seger et al. | 251/122 X |
| 5,228,604 | A | * | 7/1993 | Zanini et al. | 222/504 |
| 5,988,202 | A | * | 11/1999 | Spitzer, Sr. | 251/122 X |

FOREIGN PATENT DOCUMENTS

| | | |
|---|---|---|
| DE | 1 586 004 | 4/1970 |
| EP | 0 480 346 | 4/1992 |
| EP | 0 850 838 | 7/1998 |
| FR | 664686 | 11/1928 |
| FR | 2 736 338 | 1/1997 |

* cited by examiner

*Primary Examiner*—William C. Doerrler
*Assistant Examiner*—John Bastianelli
(74) *Attorney, Agent, or Firm*—Stroock & Stroock & Lavan LLP

(57) ABSTRACT

Filling valve for the metered delivery of a flow of medium, having: a valve housing with a passage having an inlet opening at the top and an outlet opening at the bottom and a valve body which is accommodated in the passage, a lower end of which has a diameter which decreases in the downwards direction and an upper end of which is connected to actuation means for vertical displacement of the valve body between a closed position and an open position of the valve, which respectively serves to block and allow through a flow of medium via the passage and through the outlet opening. A bottom section of the lower end of the valve body has a stepped shape, with a diameter which decreases in the downward direction.

6 Claims, 2 Drawing Sheets

FILLING VALVE

BACKGROUND OF THE INVENTION

The invention relates to a filling valve for metered delivery of a flow of medium.

A filling valve of this type is known from EP-A-0 480 346. The known filling valve has a valve body with a drop-shaped lower end. The medium may be supplied under pressure in order to allow a specific amount of medium quickly through the outlet opening of the filling valve into a container, such as a bottle, which is positioned beneath the outlet opening. However, requirements are imposed on the stability and the velocity profile of a jet of medium coming out of the filling valve and the impact force of the medium in the container, in order to minimize foaming of the medium in the container and thus the time required to fill the container. These requirements can be satisfied to a certain extent by using the drop shape.

Furthermore, the inventors have found that the best way to satisfy the abovementioned requirements is for the downwards velocity of the medium of the jet to be uniform over the entire cross section of the jet. To achieve this, the surface of the lower end of a valve body gradually changes in the downwards direction, preferably becomingly increasingly vertical and ending in a sharp point.

Furthermore, the surfaces of the lower ends of the said valve bodies are smooth.

Therefore, said valve bodies have the drawback that, after the outlet openings have been closed, in which position a bottom section of the lower end of the valve body projects outwards, medium which remains suspended from this bottom section can easily flow towards the bottommost point of the valve body. Consequently, one or more drops may be formed in the vicinity of the point and then fall off the point. Dripping of this nature is often extremely undesirable, since the drops may contaminate following containers and/or the filling machine of which the filling valve forms part. Especially in the case of aseptic conditions, such as those which are used for filling containers with milk and juices, it is possible that the aseptic, hygienic quality cannot be ensured, the containers may be inadequately sealed, and it is possible that labels will fail to adhere or will not adhere to a sufficient extent, with the result that numerous maintenance and cleaning operations may be required.

SUMMARY OF THE INVENTION

The object of the invention is to eliminate the abovementioned drawbacks.

To this end, the invention provides a filling valve for metered delivery of a flow of medium. This ensures that the medium which is located at the lower end of the valve body after the filling valve has been closed remains where it is, spread over the steps of the stepped lower end of the valve body. This allows dripping to be prevented to a considerable extent.

The filling valve is suitable both for media without or with fibres, such as fibre-containing fruit juices.

BRIEF DESCRIPTION OF THE PREFERRED EMBODIMENTS

Other features and advantages of the invention will emerge from the following explanation of embodiments of the filling valve according to the invention in combination with the appended drawings, in which.

DETAILED DESCRIPTION OF THE EMBODIMENTS

Figure 1:
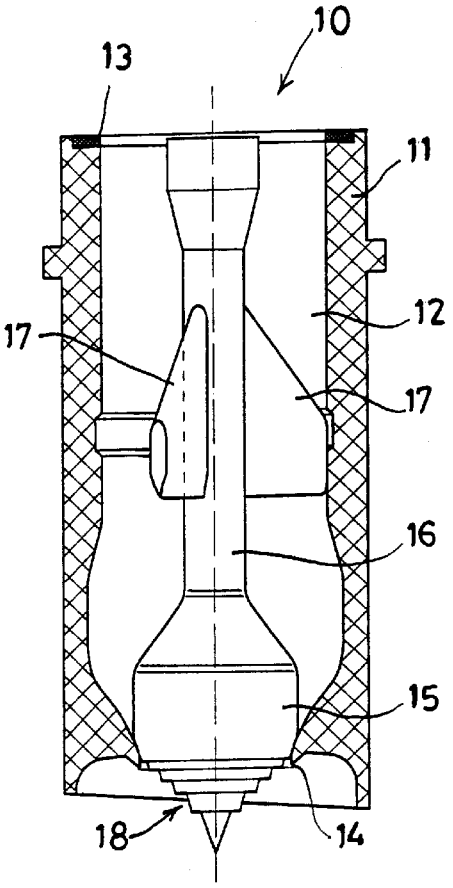
FIG. 1 shows a cross section through a first embodiment of a filling valve according to the invention, in a closed position.

FIG. 1 shows a filling valve 10, comprising a housing 11 with a vertical passage 12, having an inlet opening 13 at the top and having an outlet opening 14 at the bottom. In the passage there is a valve body 15 which, at the top, is connected to an actuating rod 16, by means of which the valve body 15 can be displaced in the vertical direction. The rod 16 is of relatively small cross section in relation to the passage 12 and has radially protruding fins 17 which are supported against the wall of the passage 12, in order to guide the vertical displacement of the rod 16 with the valve body 15.

Figure 2:
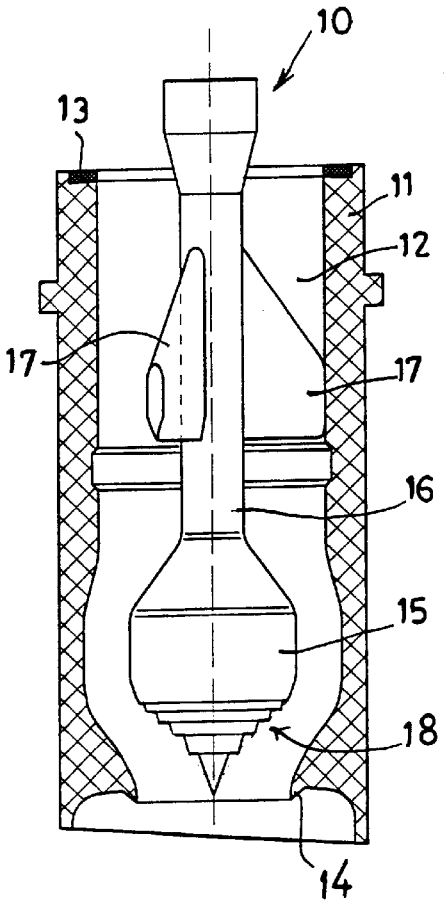
FIG. 2 shows a cross section through the filling valve of FIG. 1, in the open position.

In the closed position of the filling valve 10, which is shown in FIG. 1, the valve body 15 is supported in a sealing manner against an edge section of the outlet opening 14. After the rod 16, and thus the valve body 15, have been lifted, the open position of the filling valve 10, which is shown in FIG. 2, is reached. In the open position of the filling valve 10, medium which is supplied under pressure via the inlet opening 13 and the passage 12 can leave the outlet opening 14 by moving past the valve body 15. The shape and dimensions of the said components 11, 15, 16, 17 of the filling valve 10, in particular of the bottom section 18 of the filling body 15, are preferably such that the medium leaves the filling valve 10 in a jet which has a substantially uniform velocity over its entire cross section.

When the filling valve 10 is closed after medium has passed through, medium will remain behind on the surface of the bottom section 18. To prevent this remaining quantity of medium from dripping after the valve 10 has been closed, the bottom section 18 of the valve body 15, according to the invention, is in stepped form. The remaining medium is then held in place on the steps.

Figure 3:
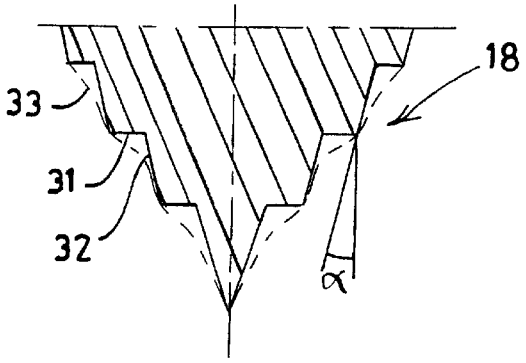
FIG. 3 shows a cross section through a bottom section of the valve body of the filling valve shown in FIGS. 1 and 2.

FIG. 3 shows an advantageous embodiment of the stepped bottom section 18 of the valve body 15 on a larger scale. The stepped shape has annular, radial surface sections or plateaus 31 and substantially axial annular surface sections 32. The axial surface sections 32 form an angle $\alpha$ of between 10° and 20° with the vertical (parallel to the centre axis of the actuating rod 16). Furthermore, the axial surface sections are of different heights which increase towards the bottom. As a result, if the outer corners of the steps were to be joined by an imaginary plane, this surface would exhibit a convergence which decreases towards the bottom. In other words, the imaginary plane becomes gradually more vertical towards the bottom and ends in a sharp point.

In FIG. 3, a dashed line 33 indicates the medium which remains attached to the bottom section of the valve body 15 after the filling valve 10 has been closed.

It has been found that a filling valve 10 with a valve body 15 which has a bottom section 18 of this nature allows dripping to be prevented to a very large extent, both in the case of a medium without fibres and in the case of a medium which contains fibres, such as fibre-containing fruit juices.

Figure 4:
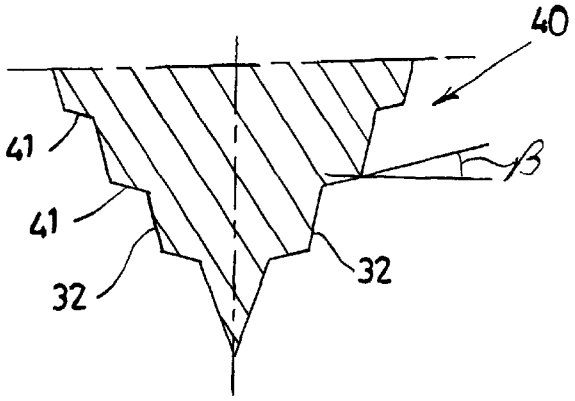
FIG. 4 shows a cross section through a bottom section of another embodiment of a valve body.

FIG. 4 shows a cross section through a differently shaped bottom section 40 of a valve body, which differs from the bottom section 18 shown in FIG. 4 in that the radial plateaus 31 are replaced by inclined surface sections 41 which form an angle β with the horizontal (i.e. the plane which is perpendicular to the center axis of the bottom section 40). The angle β is preferably between 0° and 20°. This means that the steps have less abrupt transitions, thus counteracting any undesirable disruption to the jet of medium caused by abrupt step transitions.

The invention can be used for filling valves with various forms of flow passage and of valve body.

Figure 5:
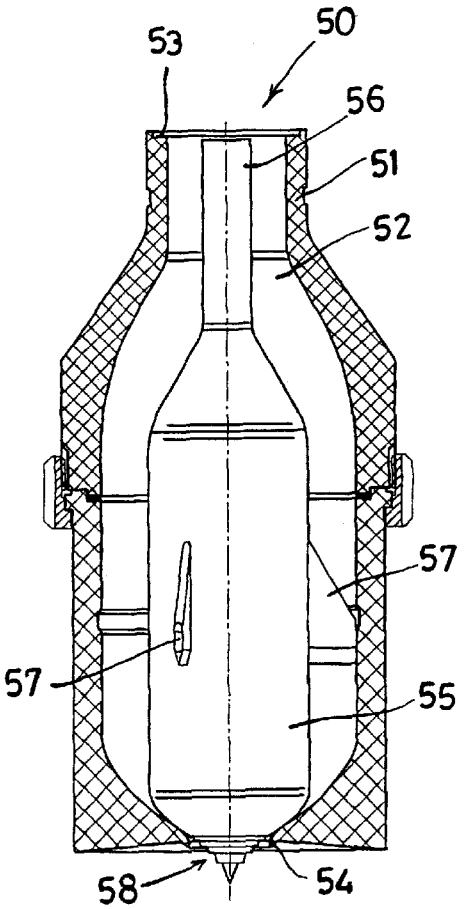
FIG. 5 shows a cross section through another embodiment of the filling valve according to the invention, in the closed position.

FIG. 5 shows an embodiment of a filling valve 50 comprising a housing 51 which is formed by two halves which are placed against one another, with a flow passage 52 having an inlet opening 53 at the top and having an outlet opening 54 at the bottom. In the passage 52, there is a valve body 55 which can be displaced in the vertical direction by means of a rod 56 attached thereto. Radial fins 57, which are supported against the wall of the passage 52 and are used to guide the vertical displacement, are arranged on the outside of the valve body 55.

Figure 6:
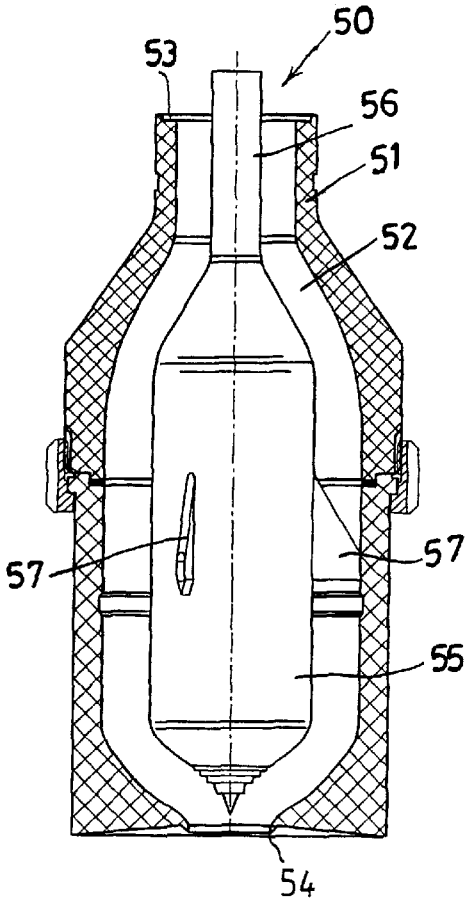
FIG. 6 shows a cross section through the filling valve of FIG. 5, in the open position.

FIG. 5 shows the filling valve 50 in its closed position, and FIG. 6 shows the filling valve 50 in its open position.

As can be seen by comparing the figures, the valve body 55, compared to the valve body 15, has a considerably greater cross section with respect to the respective outlet opening 54, 14 which the body is able to close. The lower end of the valve body 55 therefore has a gradually decreasing diameter over a greater height, in which case the decrease is initially greater. However, it is true of both valve bodies 15 and 55 that only the respective bottom sections 18, 58, which in the closed position of the valve 10, 50 project outwards, are of stepped form.

What is claimed is:

1. Filling valve for metered delivery of a flow of medium, comprising:

a valve housing with a passage having an inlet opening at the top and having an outlet opening at the bottom, said passage being coaxial with said inlet opening and said outlet opening; and a valve body which is accommodated in the passage, a lower end of which has a diameter which decreases in the downwards direction and an upper end of which is connected to actuation means for vertical displacement of the valve body between a closed position and an open position of the valve, which respectively serve to block and allow through a flow of medium via the passage, through the outlet opening;

wherein a bottom section, which in the closed position projects out of the passage, of the lower end of the valve body is of stepped form, with a diameter which decreases in the downwards direction;

wherein substantially axial surface sections of the step shape run obliquely downwards at an acute angle of inclination (α) towards the center axis of the valve body.

2. Filling valve according to claim 1, wherein the bottom section of the valve body ends in a sharp point.

3. Filling valve according to claim 1, wherein the heights of the steps of the step shape increase towards the bottom.

4. Filling valve according to claim 1, wherein the angle of inclination (α) of the substantially axial surface sections of the step shape is between 10° and 20°.

5. Filling valve according to claim 1, wherein substantially radial surface sections of the step shape run obliquely downwards at an acute angle (β) from an outer edge of these sections.

6. Filling valve according to claim 1, wherein the substantially radial surface sections of the step shape run obliquely downwards at an acute angle (β) from an outer edge of these sections, and the angle of inclination (β) of the substantially radial surface sections of the step shape is between 0° and 20°.

* * * * *